US011712785B2

(12) United States Patent
Lang et al.

(10) Patent No.: US 11,712,785 B2
(45) Date of Patent: Aug. 1, 2023

(54) WORKPIECE CLAMPING DEVICE WITH COUPLING BODY BETWEEN CLAMPING BODY AND THREADED SPINDLE

(71) Applicant: Lang Technik GmbH, Holzmaden (DE)

(72) Inventors: Philipp Lang, Holzmaden (DE); Guenter Lang, Wernau (DE)

(73) Assignee: LANG TECHNIK GMBH, Holzmaden (DE)

( * ) Notice: Subject to any disclaimer, the term of this patent is extended or adjusted under 35 U.S.C. 154(b) by 248 days.

(21) Appl. No.: 17/150,144

(22) Filed: Jan. 15, 2021

(65) Prior Publication Data

US 2021/0220966 A1 Jul. 22, 2021

(30) Foreign Application Priority Data

Jan. 17, 2020 (DE) ..... 10 2020 101 062.1

(51) Int. Cl.
*B25B 1/10* (2006.01)
*B25B 1/24* (2006.01)
*B25B 1/02* (2006.01)

(52) U.S. Cl.
CPC ..... *B25B 1/10* (2013.01); *B25B 1/02* (2013.01); *B25B 1/2478* (2013.01); (Continued)

(58) Field of Classification Search
CPC ..... B25B 1/103; B25B 1/2484; B25B 1/2489; B25B 1/02; B25B 1/10; B25B 1/12; (Continued)

(56) References Cited

U.S. PATENT DOCUMENTS 4,046,364 A * 9/1977 Coope ..... B25B 1/2484 269/244
4,448,406 A * 5/1984 Hallberg ..... B25B 1/103 269/244

(Continued)

FOREIGN PATENT DOCUMENTS

DE 102006062318 A1 7/2007
DE 102009044497 * 6/2010

(Continued)

OTHER PUBLICATIONS

Lang Technik Zero=Point Clamping Catalog (Year: 2022).*
German Office Action for Application No. 10 2020 101 062.1.
European Search Report for Application No. EP 21 15 1292.

*Primary Examiner* — Mahdi H Nejad
(74) *Attorney, Agent, or Firm* — Cantor Colburn LLP

(57) ABSTRACT

A workpiece clamping device having at least one base body. A first clamping body and a second clamping body are movably supported on the at least one base body in a clamping direction. A threaded spindle extends along a spindle longitudinal axis. The spindle longitudinal axis is orientated in clamping direction. It has a first thread section for the first clamping body and a second thread section for the second clamping body. A first coupling body has a first counter thread portion and a second coupling body has a second counter thread portion. In a coupling position the counter thread portions are in engagement with the assigned thread section respectively. In a decoupling position the counter thread portion is disengaged from the assigned thread section. In this decoupling position a movement of the clamping bodies is possible without rotation of the threaded spindle.

20 Claims, 5 Drawing Sheets

(52) U.S. Cl.
CPC ..... *B25B 1/2484* (2013.01); *B25B 1/2489* (2013.01); *B25B 1/2405* (2013.01)

(58) Field of Classification Search
CPC ..... B25B 1/125; B25B 1/2478; B25B 1/2405; B25B 1/2452
USPC ..... 269/242, 153, 104, 43; 156/73.5; 228/2.3, 114.5, 213; 279/123; 267/150
See application file for complete search history.

(56) References Cited

U.S. PATENT DOCUMENTS

| | | | | |
|---|---|---|---|---|
| 6,796,987 | B2 * | 9/2004 | Tague | A61B 17/8822 606/94 |
| 7,155,871 | B1 | 1/2007 | Stone et al. | |
| 7,758,274 | B2 * | 7/2010 | Paul | A61B 17/00 403/104 |
| 9,272,378 | B1 * | 3/2016 | Miller | B23Q 1/28 |
| 10,520,113 | B1 * | 12/2019 | Thompson | F16L 3/22 |
| 11,110,568 | B2 * | 9/2021 | Taylor | B25B 1/103 |
| 11,383,354 | B1 * | 7/2022 | Taylor | B25B 1/2478 |
| 2015/0183093 | A1 * | 7/2015 | Yan | B25B 1/02 269/204 |
| 2015/0343606 | A1 * | 12/2015 | Lin | B25B 1/2405 269/153 |
| 2018/0272499 | A1 * | 9/2018 | Cheng | B25B 1/2489 |
| 2019/0091836 | A1 * | 3/2019 | Schleusener | B25B 1/18 |
| 2019/0389036 | A1 * | 12/2019 | Taylor | B25B 1/2452 |
| 2020/0238478 | A1 * | 7/2020 | Bronzino | B25B 5/102 |

FOREIGN PATENT DOCUMENTS

| | | | | |
|---|---|---|---|---|
| DE | 102012112755 | A1 | 6/2014 | |
| DE | 102014111802 | A1 | 2/2016 | |
| DE | 102015219281 | B3 | 2/2017 | |
| DE | 102017122112 | A1 | 3/2019 | |
| DE | 102020101064 | B3 * | 3/2021 | B25B 1/02 |
| DE | 102020101059 | A1 * | 7/2021 | |
| EP | 0742081 | A2 * | 11/1996 | |
| GB | 2338913 | A * | 1/2000 | B25B 1/103 |

* cited by examiner

WORKPIECE CLAMPING DEVICE WITH COUPLING BODY BETWEEN CLAMPING BODY AND THREADED SPINDLE

CROSS REFERENCE TO RELATED APPLICATIONS

This application claims priority under 35 U.S.C. § 119 to the following German Patent Application No. 10 2020 101 062.1, filed on Jan. 17, 2020, the entire contents of which are incorporated herein by reference thereto.

BACKGROUND

The invention refers to a workpiece clamping device having a first clamping body and a second clamping body. The workpiece clamping device is configured to directly or indirectly clamp a workpiece between the clamping bodies. The clamping bodies are movably arranged on at least one base body. The shifting of the clamping bodies toward or away from each other can be carried out by rotation of a threaded spindle around a spindle longitudinal axis in order to clamp or release a workpiece.

Such a workpiece clamping device is known, for example, from DE 10 2017 122 112 A1. There the clamping bodies are provided with a threaded bore and are in engagement with the threaded spindle.

BRIEF SUMMARY

Starting from this prior art, it is an object of the present invention to simplify the adaption of the workpiece clamping device to workpieces having different sizes. This task is solved by means of the workpiece clamping device as disclosed and claimed herein.

A workpiece clamping device, including: at least one base body that is configured to be arranged on a support, a first clamping body and a second clamping body that are movably supported on the at least one base body in a clamping direction, a threaded spindle extending in clamping direction along a spindle longitudinal axis and comprising a first thread section for the first clamping body and a second thread section for the second clamping body, wherein the first clamping body has a first coupling body and the second clamping body has a second coupling body, the first coupling body and the second coupling body movable between a coupling position and a decoupling position, the first coupling body and the second coupling body each comprise a counter thread portion on an end assigned to the threaded spindle that is in engagement with the first thread section or the second thread section in the coupling position and is disengaged from the first thread section and the second thread section in the decoupling position.

According to the present disclosure, the workpiece clamping device has at least one base body and preferably at least two base bodies. The at least one base body is configured to be arranged on a support. The support can be formed by one or more support plates. Preferably an attachment device is provided in order to arrange the at least one base body releasably on the carrier in a force-fit and/or form-fit manner.

A first clamping body and a second clamping body are slidably supported in a clamping direction on the at least one base body. In an embodiment the first clamping body can be slidably supported on a first base body and the second clamping body can be slidably supported on a second base body. The two base bodies are configured as separate bodies and particularly arranged with distance in clamping direction.

A threaded spindle that is rotatable around a spindle longitudinal axis extends in clamping direction along the at least one base body. The threaded spindle has a first thread section for the first clamping body and a second thread section for the second clamping body. Preferably the first thread section and the second thread section have different rotation directions or rotation senses. For example, the first thread section may be a right-hand thread and the second thread section may be a left-hand thread or vice versa.

The workpiece clamping device comprises a coupling body for each clamping body. Each coupling body is movable, e.g. slidable, between a coupling position and a decoupling position. Each coupling body has an end that is assigned to the first thread section or the second thread section and comprises a counter thread portion. The counter thread portion is a thread that is not completely closed in thread rotation direction or in circumferential direction.

In the coupling position the counter thread portion engages the assigned first thread section or the assigned second thread section. Therefore, during a rotation of the threaded spindle a movement of the clamping body in clamping direction is caused. In the decoupling position of the respective coupling body the counter thread portion is out of engagement with the assigned first thread section or second thread section. Thus, no drive coupling exists between the threaded spindle and the clamping body. The clamping body can be positioned quickly and without rotation of the threaded spindle relative to the at least one base body. In doing so, a quick adjustment of the position of the clamping body in clamping direction is possible in order to adapt the workpiece clamping device to workpieces of different sizes. Particularly very long threaded spindles would otherwise require a time-consuming rotation movement for adjustment of the clamping bodies, if they would have to be moved along a respectively long path in clamping direction.

Preferably the first thread section and the second thread section have the same thread pitch amount.

It is also preferred, if the clamping bodies have the same distance to a center plane respectively, that is orientated orthogonal to the clamping direction. The center plane intersects the threaded spindle between the first thread section and the second thread section. During a rotation of the threaded spindle and if both coupling bodies are in their coupling position, the two coupling bodies move along equal distances relative to the center plane toward each other or away from each other, depending on the rotation direction of the threaded spindle.

It is advantageous, if the workpiece clamping device has a first coupling body for the first clamping body and a second coupling body for the second clamping body, wherein the second coupling body distinguishes from the first coupling body. The two coupling bodies have particularly counter thread portions with opposite rotation direction, adapted to the assigned first thread section or second thread section respectively.

It is advantageous, if each clamping body has a mounting recess. The mounting recess is configured to locate the assigned coupling body, particularly if it takes the coupling position. Preferably the mounting recess extends completely through the clamping body in a direction orthogonal to the spindle longitudinal axis. In doing so, the coupling body can be inserted in the mounting recess on a side facing away from the threaded spindle and can, in the coupling position, project with its end assigned to the threaded spindle from the mounting recess in order to get into engagement with the first thread section or the second thread section.

In an embodiment each coupling body has a base part. The base part is configured for releasable attachment of the coupling body on the assigned clamping body and can cooperate with an assigned locking device for this purpose. In the coupling position the coupling body is preferably held on the assigned clamping body by means of the base part in a force-fit and/or form-fit manner.

The base part can have a plate-shaped form. This means a form, wherein the thickness of the base part is smaller than the dimension of the base part in at least one direction orthogonal to the thickness.

It is preferred, if the base part comprises a stop surface that cooperates with a counter stop surface of the assigned clamping body. In the coupling position of the coupling body the stop surface of the base part abuts against the counter stop surface. In doing so, a relative position between the coupling body taking the coupling position and the clamping body can be defined in order to ensure a reliable engagement of the counter thread portion in the assigned first thread section or the assigned second thread section.

In an embodiment each coupling body can comprise a coupling part, for example, on which the counter thread portion is arranged. For example, the coupling part can project transverse from the base part up to an end that is assigned to the threaded spindle and on which the counter thread portion is arranged. Thereby the coupling part can be orientated orthogonal to the threaded spindle. In addition or as an alternative, it can also be orientated orthogonal to a plane in which the stop surface of the base part extends. However, the stop surface can be orientated in an angle of more than 90° relative to the extension direction of the coupling part, e.g. if the base part tapers by means of an obliquely inclined stop surface toward the coupling part.

Each counter thread portion is not completely closed in a circumferential direction around the thread axis of the counter thread portion, but extends particularly at most 180° around the thread axis. An end surface of the end of the coupling body carrying the counter thread portion has therefore a contour corresponding to a cylinder shell surface portion that extends in circumferential direction at most 180° around the cylinder axis.

Each counter thread portion has multiple thread projections and multiple thread cavities. The thread projections of a common counter thread portion extend in an arc-shaped manner along a common helix respectively. Accordingly, the thread cavities of a common counter thread portion extend in an arc-shaped manner along a common helix respectively. Thereby each thread projection and each thread recess extends preferably 180° around the thread axis.

A locking device can be assigned to each coupling body. Preferably one individual locking device is provided for each coupling body. The locking device can comprise at least one locking body, for example. The locking device is configured to retain the coupling body in its coupling position and to lock the coupling body against a movement out of the coupling position toward the decoupling position.

Preferably each locking device can be switched between a locking position and a release position. Particularly the at least one locking body of each locking device can be moved between the locking position and the release position, preferably by means of a rotation movement or pivot movement. In an embodiment the at least one locking body of each locking device is rotatable or pivotable around an eccentric axis. Each locking body can comprise an eccentric part that is arranged eccentrically relative to the eccentric axis. For example, the eccentric axis can be defined by means of a bolt and particularly a threaded bolt. In one embodiment the bolt head has a non-rotationally symmetrical outer contour relative to the eccentric axis, e.g. an outer contour deviating from a circular contour.

The eccentric part can lock the assigned coupling body against a movement, e.g. against a shifting away from the threaded spindle in locking position of the locking device. In the release position of the locking device the eccentric part can allow movement away from the threaded spindle. For example, the eccentric part can engage the coupling body and particularly the base part in a form-fit manner and/or force-fit manner in the locking position, whereas it is arranged preferably without contact to the coupling body in the release position.

BRIEF DESCRIPTION OF THE FIGURES

Preferred embodiments of the invention can be derived from the dependent claims, the description and the drawings. In the following preferred embodiments of the invention are explained in detail with reference to the attached drawings. The drawings show:

DETAILED DESCRIPTION

Figure 1:
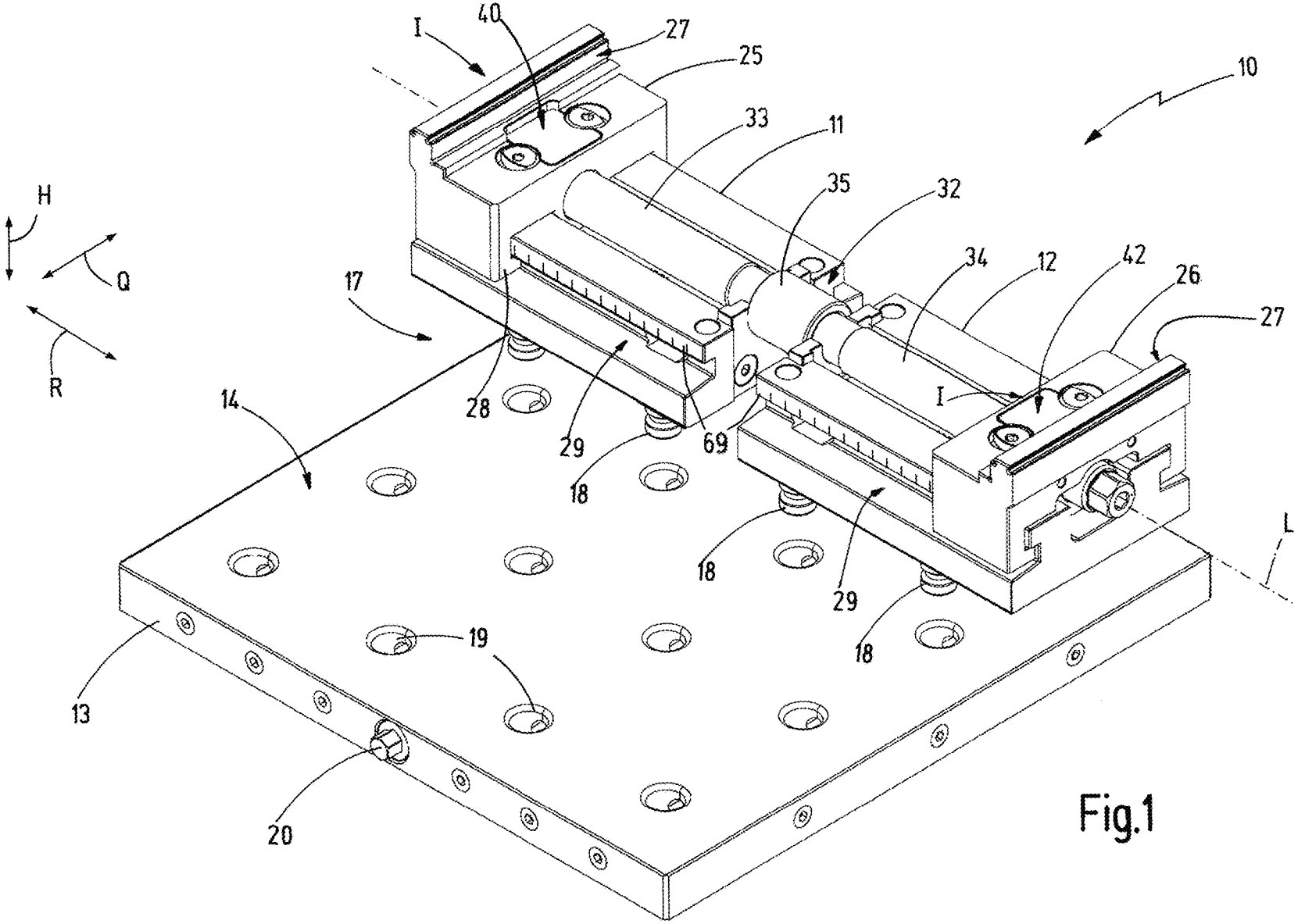
FIG. 1 a perspective illustration of an embodiment of a workpiece clamping device, FIG. 2 a perspective sectional illustration of a clamping body of the workpiece clamping device of FIG. 1, wherein a coupling body of the clamping body is in a coupling position, FIG. 3 the perspective sectional illustration according to FIG. 2, wherein a locking device assigned to the coupling body is in a locking position, FIG. 4 a schematic block-diagram-like explosion illustration of a base body, a clamping body and an assigned coupling body for an embodiment of a workpiece clamping device, FIG. 5 a schematic block-diagram-like illustration of the base body, the clamping body and the coupling body of FIG. 4, wherein the coupling body is in a decoupling position, FIG. 6 the base body, the clamping body and the coupling body of FIG. 5, wherein the coupling body is in a coupling position, FIG. 7 a first coupling body with view on the end of the first coupling body assigned to the first thread section and FIG. 8 a second coupling body with view on the end of the second coupling body assigned to the second thread section.

FIG. 1 shows an embodiment of a workpiece clamping device 10. The workpiece clamping device 10 comprises at least one base body and in the embodiment first base body 11, as well as a second base body 12 that is separate from the first base body 11. The two base bodies 11, 12 are configured to arrange the workpiece clamping device 10 on a support 13. The support 13 has a support surface 14 that is planar, at least in sections. Each base body 11, 12 has a bottom side that is planar, at least in sections, and is configured to be arranged on the support surface 14 of the support 13. In the illustrated embodiment the support surface 14 extends completely in one single plane that is defined by a clamping direction R and a transverse direction Q orientated orthogonal to the clamping direction R. A height direction H is orientated orthogonal to the clamping direction R and to the transverse direction Q. The height direction H, the transverse direction Q and the clamping direction R define a coordinate system of the workpiece clamping device 10.

The base bodies 11, 12 can be arranged on the support 13 in a form-fit and/or force-fit manner. For this an attachment device 17 is provided. In the embodiment attachment pins 18 are part of the attachment device 17 that project from the bottom side of each base body 11, 12, wherein at least three and according to the example, four attachment pins 18 are arranged on each base body. In the support 13 holes 19 are provided that open in the support surface 14, in which the attachment pins 18 can be inserted. Inside the support 13 clamping slides are arranged, the ends of which are assigned to one of the holes 19 respectively that can be actuated and, for example, slided by means of an operating element 20. In doing so, an attachment pin 18 that is arranged inside a hole 19, can be clamped by means of the assigned clamping slide a form-fit and/or force-fit manner. The force created thereby can have a component transverse to the extension direction of the attachment pin 18 and a component in extension direction of the attachment pin 18 such that the bottom side of the base body 11, 12 is pulled against the support surface 14. The operating element 20 of the support 13 is accessible from outside and can be, for example, a screw.

The first base body 11 and the second base body 12 are arranged with distance to each other in clamping direction R. A first clamping body 25 is slidably arranged in clamping direction R on the first base body 11. A second clamping body 26 is slidably arranged in clamping direction R on the second base body 12. A clamping surface 27 for engagement of a workpiece to be clamped is provided on each clamping body 25, 26 in the embodiment. As an alternative or in addition, an appropriate connection device can be provided on each clamping body 25, 26 in order to be able to arrange one separate clamping jaw on each clamping body 25, 26. In turn, a clamping surface for clamping of a workpiece can be provided on the clamping jaw.

Each clamping body 25, 26 has guide elements 28 arranged with distance from one another in transverse direction Q that cooperate with a guide 29 on the first base body 11 or on the second base body 12 respectively in order to guide the first clamping body 25 and the second clamping body 26 in clamping direction R. Between the two guide elements 28 the clamping body 25, 26 has a central part 30 with an opening 31 extending completely through the clamping body 25, 26 in clamping direction R. A section of a threaded spindle 32 extends through the opening 31. The threaded spindle 32 extends along the first base body 11 and the second base body 12. The threaded spindle 32 has a spindle longitudinal axis L that extends in clamping direction R. The threaded spindle 32 has a first thread section 33 arranged adjacent to the first base body 11. The threaded spindle 32 has a second thread section 34 arranged adjacent to the second base body 12. The two thread sections 33, 34 can be arranged on separate spindle parts that are connected with each other between the thread sections 33, 34 by a central piece, e.g. a sleeve 35.

In the embodiment the two thread sections 33, 34 have opposite rotation directions. For example the first thread section 33 can be configured as right-hand thread and the second thread section 34 can be configured as left-hand thread or vice versa. The thread pitch amounts of the two thread sections 33, 34 are equal.

The threaded spindle 32 extends with its first thread section 33 through the opening 31 of the first clamping body 25 and with the second thread section 34 through the opening 31 of the second clamping body 26. A first coupling body 40 having a first counter thread portion 41 is assigned to the first clamping body 25. A second coupling body 42 having a second counter thread portion 43 is assigned to the second clamping body 26. The first counter thread portion 41 is adapted to the rotation direction and the thread pitch of the first thread section 33 in order to allow a thread engagement between the first counter thread portion 41 and the first thread section 33. The second counter thread portion 43 is adapted to the thread pitch and the rotation direction to the second thread section 34 in order to allow a thread engagement between the second counter thread portion 43 and the second thread section 34.

Figure 3:
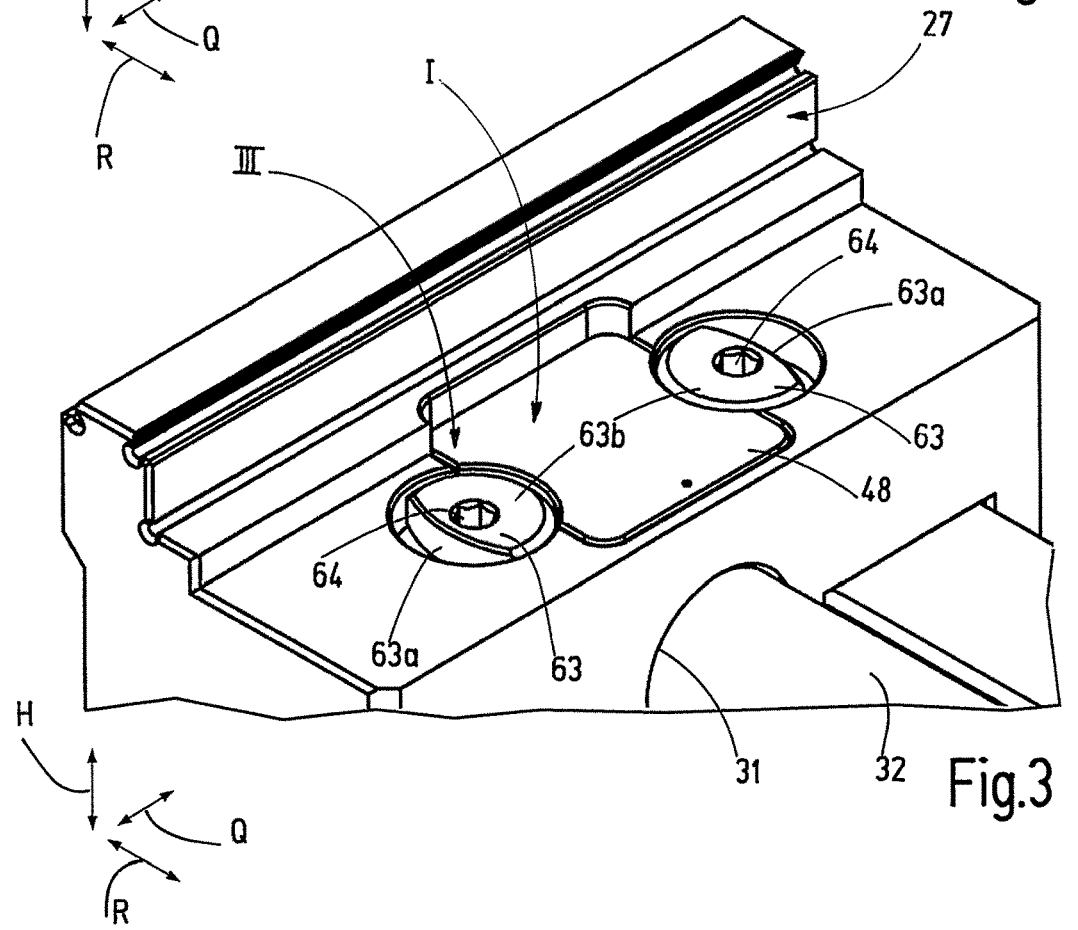
Figure 4:
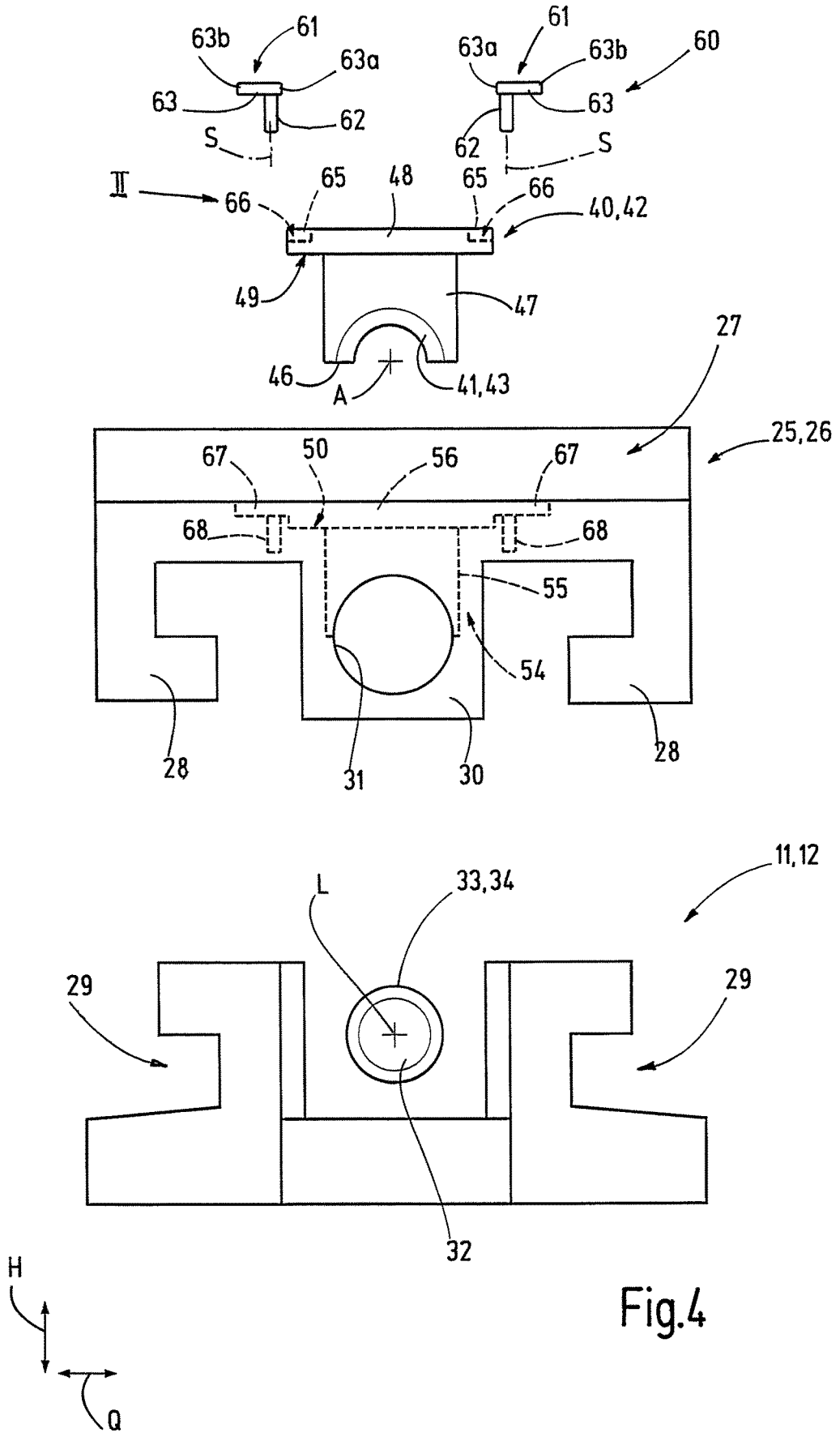
Figure 5:
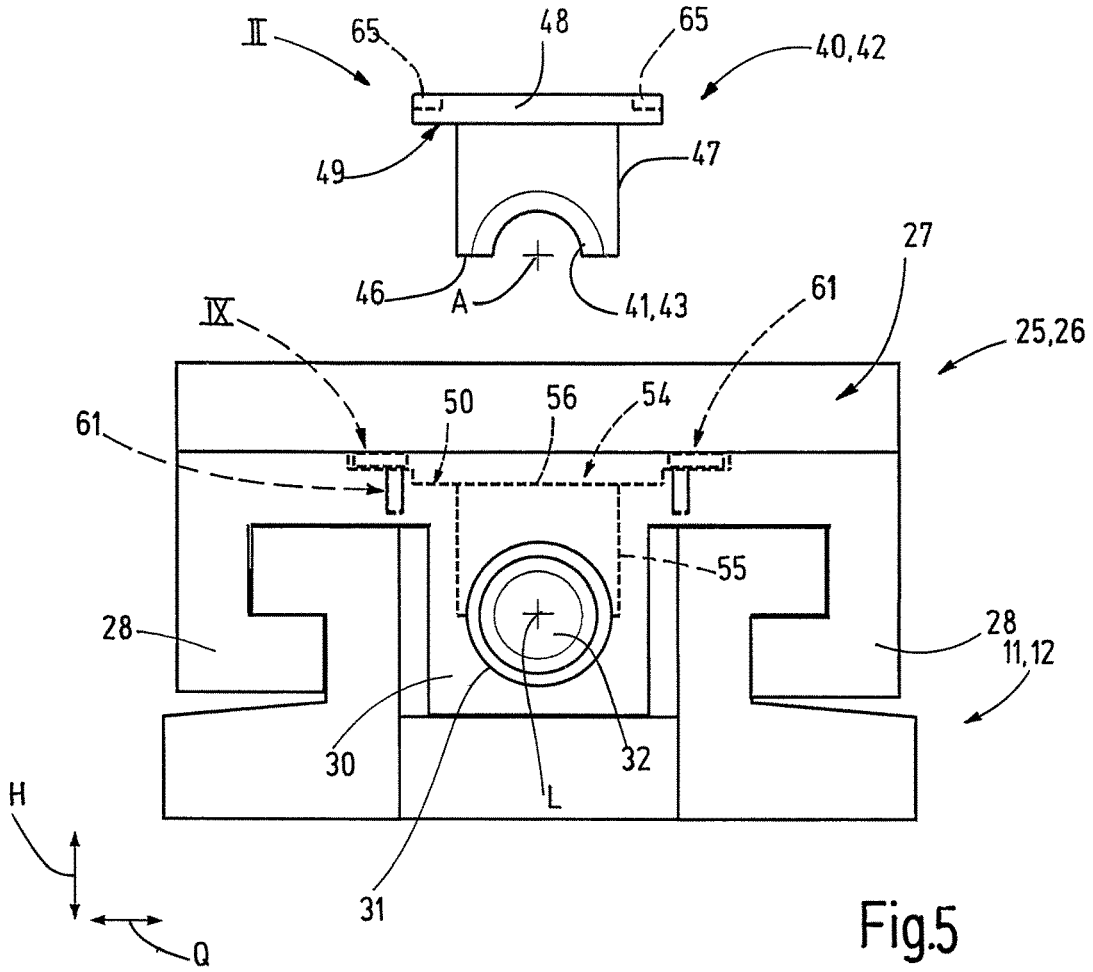
Figure 6:
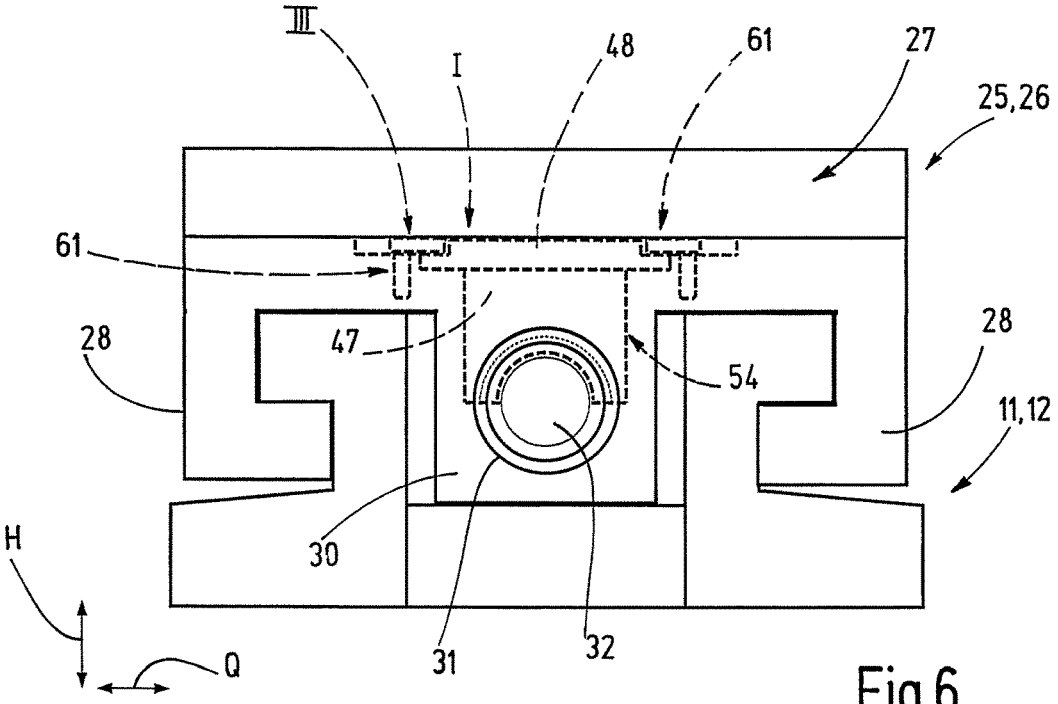

The first coupling body 40 and the second coupling body 42 are movable between a coupling position I (FIGS. 1-3 and 6) and a position II (FIGS. 4 and 5). In the coupling position of the first coupling body 40 the first counter thread portion 41 is in engagement with the first thread section 33. In the decoupling position II of the first coupling body 40 the first counter thread portion 41 is disengaged from the first thread section 33. In the coupling position I of the second coupling body 42 the second counter thread portion 43 is in engagement with the second thread section 34 of the threaded spindle 32 and in the decoupling position II of the second coupling body 42 the second counter thread portion 43 is disengaged from the second thread section 34.

Figure 7:
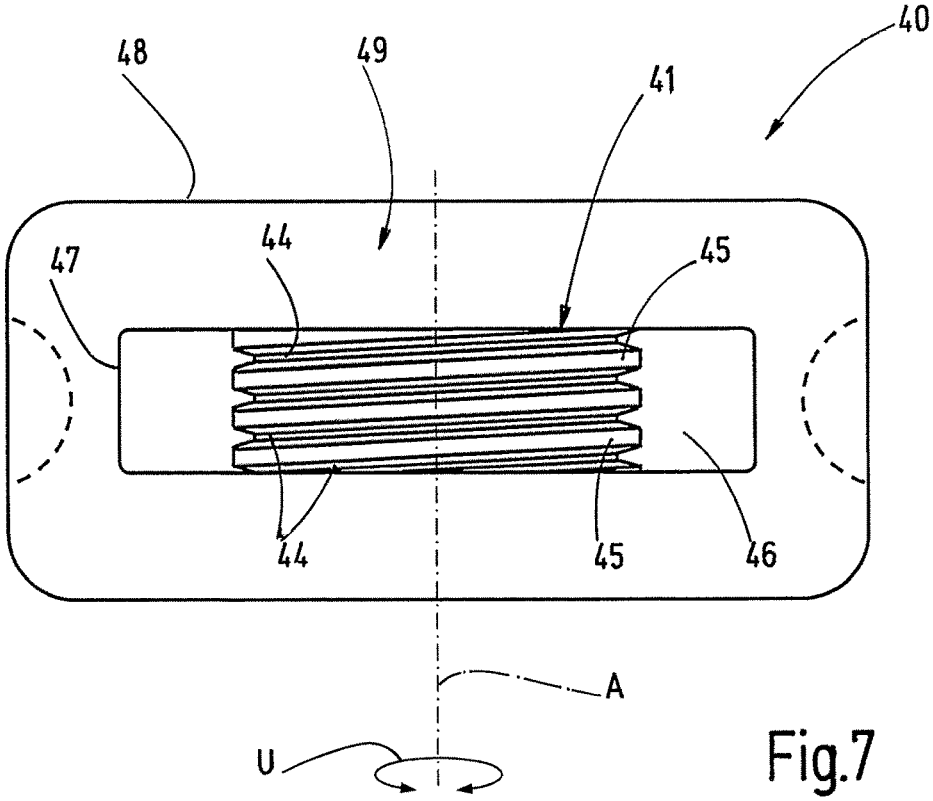
Figure 8:
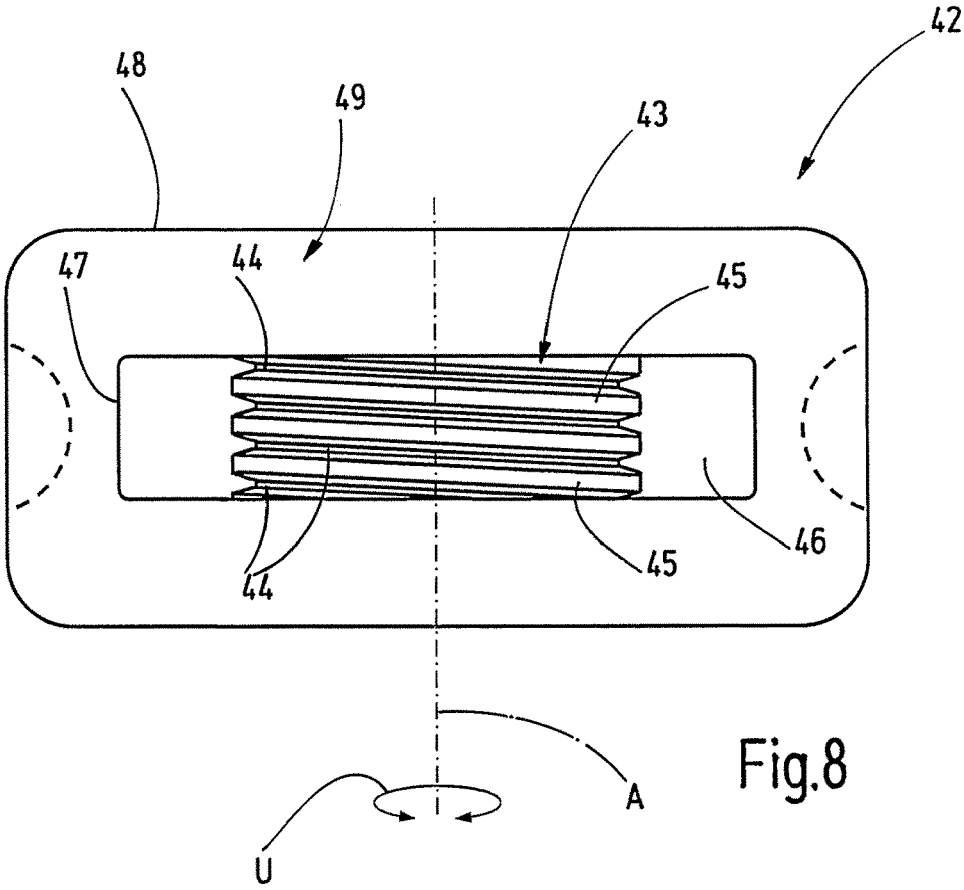

The counter thread portions 41, 43 are illustrated in FIGS. 7 and 8. Each counter thread portion 41, 43 has multiple thread projections 44 that are arranged on a common helix that extends around a thread axis A of the counter thread portion 41, 43. In addition, each counter thread portion 41, 43 has multiple thread cavities 45 that extend on a common helix around the thread axis A. The thread projections 44 and the thread cavities 45 have an extension in a circumferential direction U around the thread axis A in an angle range that has an amount of at most 180° and in the embodiment of exactly 180°. Thus, the counter thread portions 41, 43 can be brought into engagement or out of engagement with the respectively assigned thread section 33, 34 by means of a linear movement orthogonal or radial to the spindle longitudinal axis L.

The counter thread portions 41, 43 are arranged on an end 46 of the respective coupling body 40, 42 assigned to the threaded spindle 32. This end 46 is formed by an end or end section of a coupling part 47 of the coupling body 40, 42 that extends to the end 46 originating from a base part 48 of a coupling body 40, 42.

The base part 48 has a stop surface 49 on the side facing the coupling part 47 that is configured to cooperate with a counter stop surface 50 on the assigned first clamping body 25 or second clamping body 26. In the embodiment the stop surface 49 extends in one plane that is defined by the clamping direction R and the transverse direction Q. In the embodiment the coupling part 47 of the coupling body 40, 42 is orientated orthogonal to the stop surface 49. The coupling part 47 extends particularly originating from the stop surface 49 to the end 46. At the joint location between the coupling part 47 and the base part 48 the stop surface 49 can surround the coupling part 47 completely or can only project laterally beyond the coupling part 47 at least at one location.

A mounting recess 54 is provided in the clamping body 25, 26, the contour of which is substantially matching the contour of the coupling body 40, 42, such that the coupling part 47 can slide in height direction H in a guided manner inside the mounting recess 54. The mounting recess 54 has a first section 55 that opens in the opening 31 and that is configured for location of the coupling part 47. A second section 56 adjoins the first section 55 on the side opposite the opening 31, wherein the second section 56 is configured for location of the base part 48. The second section 56 is larger than the first section 55 in transverse direction Q and/or in clamping direction R. the counter stop surface 50 is formed in the second section 56 adjoining the first section 55.

In the assembled condition, if the guide elements 28 of the clamping body 25, 26 engage the assigned guides 29 of the base body 11, 12, the threaded spindle 32 passes through the opening 31 of the clamping body 25, 26. The diameter of the opening 31 is larger than the outer diameter of the threaded spindle 32 or the first thread section 33 and the second thread section 34. In doing so, the clamping body 25, 26 can be shifted in an unimpeded manner in clamping direction R along the threaded spindle 32, if the coupling body 40, 42 is in its decoupling position II.

For coupling of the clamping body 25, 26 with the threaded spindle 32, the coupling body 40, 42 is brought into its coupling position I and for this purpose is inserted into the mounting recess 54 so far that the stop surface 49 abuts against the counter stop surface 50. Then the counter thread portion 41, 43 is in engagement with the assigned thread section 33, 34 of the threaded spindle 32. The shifting of the clamping body 25, 26 relative to the base body 11, 12 is in the coupling position I of the coupling body 40, 42 only possible, if the threaded spindle 32 is rotated around the spindle longitudinal axis L.

In order to retain the coupling body 40, 42 in the coupling position I and in order to avoid an unintentional movement away from the spindle longitudinal axis L, the workpiece clamping device 10 comprises one locking device 60 for each coupling body 40, 42. The locking device 60 can be moved between a locking position III (FIGS. 3 and 6) and a release position IV (FIG. 5). In the release position IV sliding of the coupling body 40, 42 in the mounting recess 54 is allowed, whereas the locking position III blocks sliding of the coupling body 40, 42 in the mounting recess 54.

In the embodiment each locking device 60 comprises two separate locking bodies 61. In the embodiment each locking body 61 has a bolt 62 that defines an eccentric axis S. On the end of the bolt 62 a bolt head is provided that forms an eccentric part 63 that is eccentrically supported around the eccentric axis S.

An embodiment of the locking device 60 or the locking bodies 61 is apparent from FIG. 3. In extension of the bolt 62 the eccentric part 63 comprises a tool engagement surface 64 that can be realized, for example, as hexagon socket, hexalobular socket, slot, cross slot or in another known manner. The eccentric part 63 has a non-rotational symmetric contour relative to the eccentric axis S. The eccentric part 63 has different dimensions on the sides that are opposed to each other relative to the eccentric axis S with view orthogonal to the eccentric axis S. According to the example, it comprises a first eccentric section 63*a* and a second eccentric section 63*b* that is radially larger and that is arranged opposed to the first eccentric section 63*a* diametrically relative to the eccentric axis S.

In the embodiment the second eccentric section 63*b* extends in an arc-shaped manner around the eccentric axis S in an angle range of, for example, 180° to 200° around the eccentric axis S. The first eccentric section 63*a* adjoins the second eccentric section 63*b*. The first eccentric section 63*a* can have an arc-shaped outer contour having a larger radius, the circle center point of which is arranged offset from the eccentric axis S, according to the example. The eccentric part 63 can also have another configuration that is eccentric relative to the eccentric axis S.

Due to a rotation of the locking body 61 around the eccentric axis S, the eccentric part 63 pivots around the respective eccentric axis S and thereby can be pivoted between the locking position III and the release position IV. In the locking position III the eccentric part 63 is in contact with the coupling body 40, 42 taking the coupling position I and locks it against shifting relative to the clamping body 25, 26, for example against a movement in height direction H. For example, the second eccentric section 63*b* of the eccentric part 63 can extend partly over the base part 48 of the coupling body 40, 42.

Due to a rotation of the locking body 61, the first eccentric section 63*a* can face the adjacent base part 48 without extending over it. If all of the locking bodies 61 of the locking device 60 take this position, the locking device 60 is in the release position IV.

Figure 2:
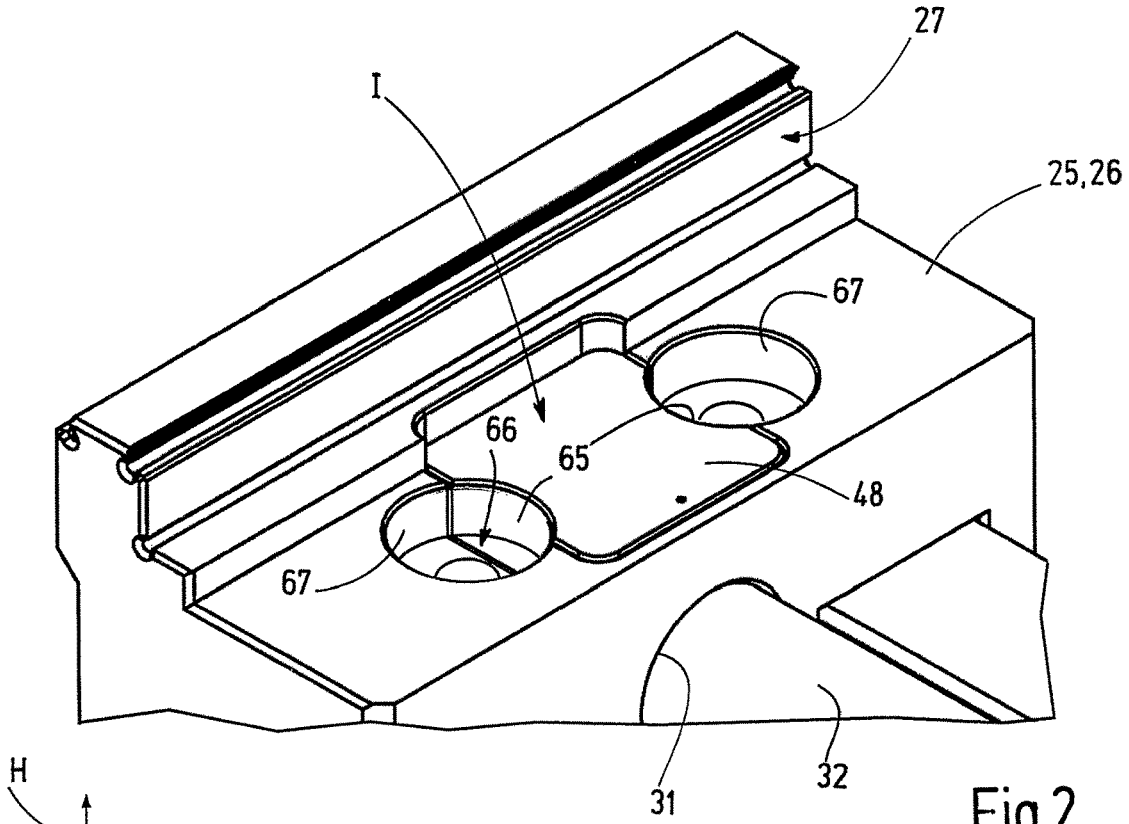

In the embodiment the base part 48 comprises a cavity 65 on two opposite sides in transverse direction Q in each case that are open in transverse direction Q. The cavity 65 is limited at least on one side in height direction H by a locking surface 66. The locking surface 66 faces away from the coupling part 47 or the counter thread portion 41, 43 or the stop surface 49. The cavity 65 can be open on the side opposite the locking surface 66 in height direction H (FIG. 2).

An eccentric cavity 67 is provided in the first clamping body 25 and the second clamping body 26 on opposite sides in transverse direction Q in each case, accessible from outside and configured to locate the eccentric part 63 of a locking body 61. In the embodiment a cavity 65 of the coupling body 40, 42 taking the coupling position I defines a cylindrical cavity together with a respective one of the eccentric cavities 67.

In extension of the eccentric cavity 67 and adjacent to the mounting recess 54, a bolt mounting hole 68 is provided in the clamping body 25, 26 that is configured for location and particularly for screwing in of the bolt 62. For this the bolt mounting hole 68 can have an inner thread and the bolt 62 can have an outer thread.

The locking device 60 operates as follows: The bolts 62 of the locking body 61 can be screwed in the assigned bolt mounting hole 68. During a rotation about 180° around the respective eccentric axis S, the eccentric part 63 can be brought into a pivot position, in that it is located inside the eccentric cavity 67 and does not project into the mounting recess 54 or extends over it. This position is illustrated in FIG. 5. The locking device 60 is then in the release position IV.

If a coupling body 40, 42 is inserted into the mounting recess 54 and if it takes the coupling position I, the locking device 60 can be switched in the locking position III, in that the eccentric parts 63 are pivoted around the respective eccentric axis S until they extend at least partly in the cavity 65 of the base part 48. Thereby the eccentric parts 63 extend the locking surface 66 adjacent to the cavity 65. In doing so, a shifting of the coupling body 40, 42 in the mounting recess 54 away from the threaded spindle 32 is blocked.

By means of the invention a quick adjustment of the clamping bodies 25, 26 along the base bodies 11, 12 can be carried out. For this the locking device 60 is brought into the release position IV and the coupling bodies 40, 42 are moved in their respective decoupling position II, in which they are disengaged from the respectively assigned thread sections 33, 34 of the threaded spindle 32. Then the clamping bodies 25, 26 can be moved relative to the threaded spindle 32 without rotation of the threaded spindle 32 around the spindle longitudinal axis L. If a desired position of the clamping bodies 25, 26 along the base body 11, 12 is reached, the coupling bodies 40, 42 are again moved in the coupling position I and the locking device 60 is subsequently brought in the locking position III. A movement of the clamping bodies 25, 26 relative to the threaded spindle 32 is no longer possible in this condition. Rather the clamping bodies 25, 26 can only be moved relative to the base body 11, 12 by rotation of the threaded spindle 32, e.g. in order to create a clamping force on a workpiece. In doing so, the workpiece clamping device 10 can be simply and quickly adapted for clamping of workpieces having different dimensions in this manner.

For positioning of the clamping bodies 25, 26 in a condition decoupled from the threaded spindle 32, a scale 69 can be provided on the base bodies 11, 12. In doing so, it is simply and quickly possible to arrange both clamping bodies 25, 26 relative to a common center plane with equal distances. The center plane extends orthogonal to the clamping direction R or to the spindle longitudinal axis L centrally between the two base bodies 11, 12 or centrally through the threaded spindle 32.

The invention refers to a workpiece clamping device 10 having at least one base body 11, 12. A first clamping body 25 and a second clamping body 26 are movably supported on the at least one base body 11, 12 in a clamping direction R. A threaded spindle 32 extends along a spindle longitudinal axis L. The spindle longitudinal axis L is orientated in clamping direction R. It has a first thread section 33 for the first clamping body 25 and a second thread section 34 for the second clamping body 26. A first coupling body 40 has a first counter thread portion 41 and a second coupling body 42 has a second counter thread portion 43. In a coupling position I the counter thread portions 41, 43 are in engagement with the assigned thread section 33 or 34 respectively. In a decoupling position II the counter thread portion 41, 43 is disengaged from the assigned thread section 33, 34. In this decoupling position II a movement of the clamping bodies 25, 26 is possible without rotation of the threaded spindle 32.

LIST OF REFERENCE SIGNS

10 workpiece clamping device
11 first base body
12 second base body
13 support
14 support surface
17 attachment device
18 attachment pin
19 hole
20 operating element
25 first clamping body
26 second clamping body
27 clamping surface
28 guide element
29 guide
30 central part
31 opening
32 threaded spindle
33 first thread section
34 second thread section
35 sleeve
40 first coupling body
41 first counter thread portion
42 second coupling body
43 second counter thread portion
44 thread projection
45 thread cavity
46 end of coupling body
47 coupling part of coupling body
48 base part of coupling body
49 stop surface
50 counter stop surface
54 mounting recess
55 first section of mounting recess
56 second section of mounting recess
60 locking device
61 locking body
62 bolt
63 eccentric part
**63*a*** first eccentric section
**63*b*** second eccentric section
64 tool engagement surface
65 cavity of base part
66 locking surface
67 eccentric cavity
68 bolt mounting hole
69 scale
I coupling position
II decoupling position
III locking position
IV release position
A thread axis
H height direction
L spindle longitudinal axis
Q transverse direction
R clamping direction
S eccentric axis

What is claimed is:

1. A workpiece clamping device, comprising:

a first base body and a second base body that are each configured to be arranged on a support, a first clamping body movably supported on the first base body in a clamping direction and a second clamping body movably supported on the second base body in the clamping direction, a threaded spindle extending in clamping direction along a spindle longitudinal axis and comprising a first thread section for the first clamping body and a second thread section for the second clamping body, wherein the first clamping body has a first coupling body and the second clamping body has a second coupling body, the first coupling body and the second coupling body movable between a coupling position and a decoupling position, the first coupling body has a first counter thread portion on an end assigned to the threaded spindle that is in engagement with the first thread section in the coupling position and is disengaged from the first thread section in the decoupling position and the second coupling body has a second counter thread portion on an end assigned to the threaded spindle that is in engagement with the second thread section in the coupling position and is disengaged from the second thread section in the decoupling position and wherein the first clamping body remains movably supported on the first base body in the clamping direction and the first clamping body is slidable with respect to the first base body and the second clamping body remains movably supported on the second base body in the clamping direction and the second clamping body is slidable with respect to the second base body, independent whether the first coupling body or the second coupling body is in the coupling position or in the decoupling position.

2. The workpiece clamping device according to claim 1, wherein the first thread section has a rotation direction that is opposite to a rotation direction of the second thread section.

3. The workpiece clamping device according to claim 1, wherein the first coupling body and the second coupling body are different from one another.

4. The workpiece clamping device according to claim 3, wherein the first counter thread portion has a rotation direction corresponding to a rotation direction of the first thread section and the second counter thread portion has a rotation direction corresponding to a rotation direction of the second thread section.

5. The workpiece clamping device according to claim 1, wherein the first clamping body has a mounting recess for arrangement of the first coupling body and the second clamping body has a mounting recess for arrangement of the second coupling body.

6. The workpiece clamping device according to claim 1, wherein the first coupling body and the second coupling body each comprise a base part that is configured for releasable attachment of the first coupling body on the first clamping body and the second coupling body on the second clamping body.

7. The workpiece clamping device according to claim 6, wherein the base part of each of the first coupling body and the second coupling body comprises a stop surface that abuts against a counter stop surface of the first clamping body and the second clamping body in the coupling position.

8. The workpiece clamping device according to claim 1, wherein the first coupling body comprises a coupling part on which the first counter thread portion is arranged and the second coupling body comprises a coupling part on which the second counter thread portion is arranged.

9. The workpiece clamping device according to claim 8, wherein the first coupling body and the second coupling body each comprise a base part that is configured for releasable attachment of the first coupling body on the first clamping body and the second coupling body on the second clamping body, and wherein the coupling part projects transverse from the base part to the end comprising a respective one of the first counter thread portion and the second counter thread portion.

10. The workpiece clamping device according to claim 1, wherein the first counter thread portion and the second counter thread portion each extend at most 180° around a thread axis in a circumferential direction about the thread axis.

11. The workpiece clamping device according to claim 10, wherein the first counter thread portion and the second counter thread portion each comprise multiple thread projections and multiple thread cavities that have a helically shaped extension.

12. The workpiece clamping device according to claim 1, wherein a locking device is provided for each of the first coupling body and the second coupling body; the locking device being configured to lock the first coupling body and the second coupling body in the coupling position.

13. The workpiece clamping device according to claim 12, wherein the locking device is movable between a locking position and a release position.

14. The workpiece clamping device according to claim 13, wherein the locking device comprises a locking body comprising an eccentric part that can be pivoted about an eccentric axis.

15. The workpiece clamping device according to claim 14, wherein the eccentric part locks the first coupling body and the second coupling body against a movement away from the threaded spindle in the locking position of the locking device and the eccentric part allows a movement away from the threaded spindle in the release position of the locking device.

16. The workpiece clamping device according to claim 2, wherein the first coupling body and the second coupling body are different from one another.

17. The workpiece clamping device according to claim 16, wherein the first counter thread portion has a rotation direction corresponding to a rotation direction of the first thread section and the second counter thread portion has a rotation direction corresponding to a rotation direction of the second thread section.

18. The workpiece clamping device according to claim 17, wherein the first clamping body has a mounting recess for arrangement of the first coupling body and the second clamping body has a mounting recess for arrangement of the second coupling body.

19. The workpiece clamping device according to claim 18, wherein the first coupling body and the second coupling body each comprise a base part that is configured for releasable attachment of the first coupling body on the first clamping body and the second coupling body on the second clamping body.

20. The workpiece clamping device according to claim 19, wherein the base part of each of the first coupling body and the second coupling body comprises a stop surface that abuts against a counter stop surface of the first clamping body and the second clamping body in the coupling position.

* * * * *